US009889917B1

(12) United States Patent
Salz

(10) Patent No.: US 9,889,917 B1
(45) Date of Patent: Feb. 13, 2018

(54) CURVE AND TILT PASSIVE CAMBERING KEEL AND STEERING FIN MASTLESS WINGSAIL

(71) Applicant: David Salz, Davie, FL (US)

(72) Inventor: David Salz, Davie, FL (US)

( * ) Notice: Subject to any disclaimer, the term of this patent is extended or adjusted under 35 U.S.C. 154(b) by 0 days.

(21) Appl. No.: 15/256,479

(22) Filed: Sep. 2, 2016

Related U.S. Application Data

(63) Continuation-in-part of application No. 15/149,037, filed on May 6, 2016.

(60) Provisional application No. 62/158,647, filed on May 8, 2015.

(51) Int. Cl.

| | |
|---|---|
| ***B63H 25/02*** | (2006.01) |
| ***B63H 25/38*** | (2006.01) |
| ***B63H 9/06*** | (2006.01) |
| ***B63B 3/38*** | (2006.01) |

(52) U.S. Cl.
CPC ..... *B63H 25/02* (2013.01); *B63B 3/38* (2013.01); *B63H 9/06* (2013.01); *B63H 9/0685* (2013.01); *B63H 25/38* (2013.01); *B63H 2025/024* (2013.01)

(58) Field of Classification Search
CPC ..... B63H 25/06; B63H 25/38; B63H 9/04; B63H 9/06; B63H 9/00; B63H 9/0607; B63B 3/38; B63B 35/73; B63B 35/793
USPC ..... 114/39.29, 39.31, 102.16, 140, 162
See application file for complete search history.

(56) References Cited

U.S. PATENT DOCUMENTS

| | | | | |
|---|---|---|---|---|
| 3,054,372 | A * | 9/1962 | Jones, Jr. | B63B 35/73 114/140 |
| 3,670,685 | A * | 6/1972 | Milessa | B63H 25/382 114/162 |
| 4,854,904 | A * | 8/1989 | Wahl | B63B 35/793 114/140 |
| 5,009,178 | A | 4/1991 | Geffken | |
| 5,046,441 | A * | 9/1991 | Kanazaki | B63H 25/382 114/162 |
| 6,349,659 | B1 | 2/2002 | Hood | |
| 6,439,940 | B1 | 8/2002 | Pouchkarev | |
| 9,242,710 | B2 * | 1/2016 | Rolla | B63H 25/382 |

* cited by examiner

*Primary Examiner* — Lars A Olson
(74) *Attorney, Agent, or Firm* — Malin Haley DiMaggio & Bowen, P.A.

(57) ABSTRACT

A flexible steering fin and passive cambering keel for sailboats having fundamental simplicity yet enhanced performance and superior operation in terms of design and components. The steering fin is a relatively short and elongated flexible blade with its leading edge fixed beneath the hull. A rod passing through the hull functions as a simple lever controlling the trailing edge of the blade, which provides both tilt and curvature for unique handling and ease of use. A separate flexible keel provides the function of tilting the keel as it is cambered, for greater lift. A unique pivoting resilient steering assembly is incorporated, along with a rotational circular hull section, frame and cam assembly to control the keel.

9 Claims, 11 Drawing Sheets

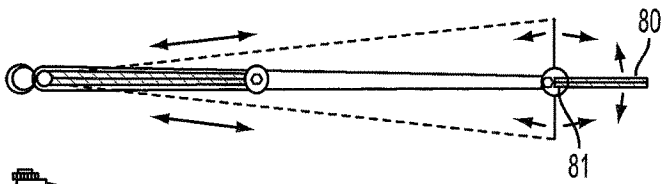
FIG. 8A
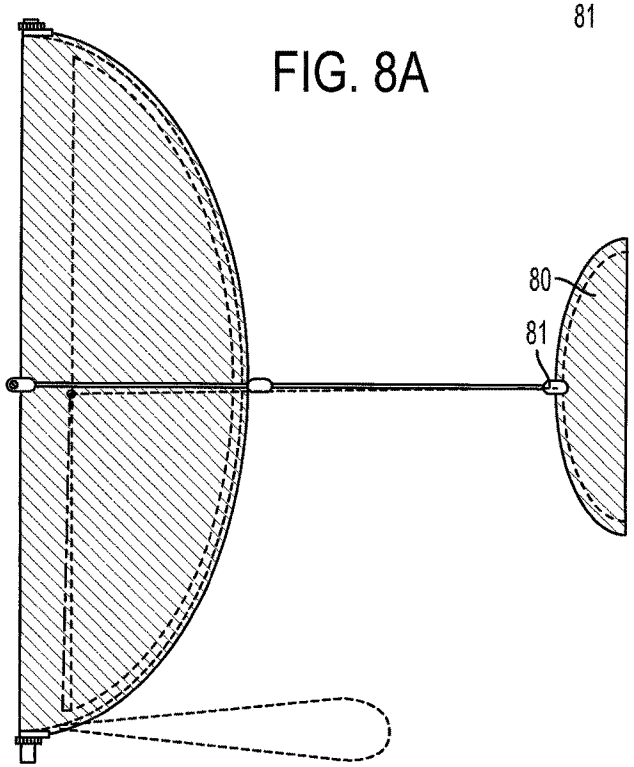
FIG. 8B
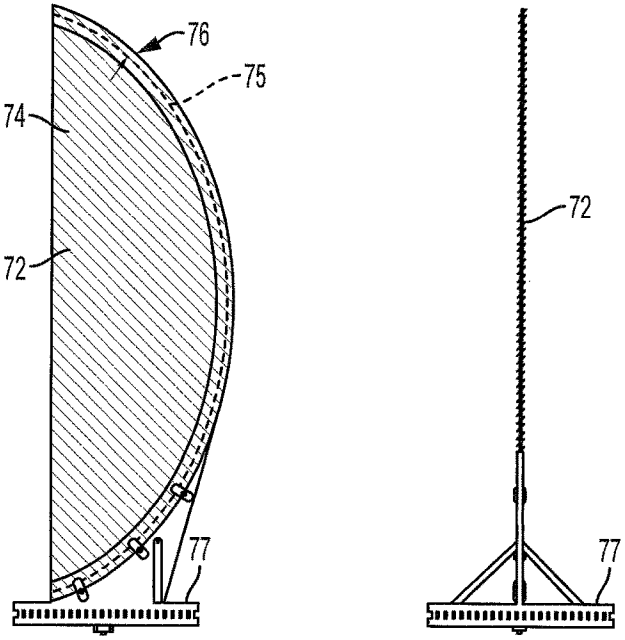
FIG. 7B
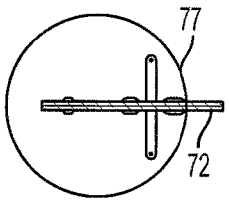
FIG. 7C
FIG. 7A

CURVE AND TILT PASSIVE CAMBERING KEEL AND STEERING FIN MASTLESS WINGSAIL

CROSS REFERENCE TO RELATED APPLICATIONS

This continuation-in-part utility application claims the benefit of U.S. Provisional Application No. 62/158,647, filed on May 8, 2015; as well as U.S. Utility Application Ser. No. 15/149,037 filed May 6, 2016.

STATEMENT REGARDING FEDERALLY SPONSORED RESEARCH OR DEVELOPMENT

N/A

BACKGROUND OF THE INVENTION

1. Field of the Invention

The present invention relates generally to sailing vessels, and more particularly to unique designs for flexible and resilient sailboat keels and steering control fins, a wingsail having no conventional mast, support members, hardware assemblies, as well as operation and control components.

2. Description of the Prior Art

Since their invention over thousands of years ago, sailboats have evolved in a multitude of fascinating ways. Many of the design advances made during that time were practical in nature, such as improving safety and simplifying operation, while others were made specifically to increase boat speed. Many different designs have also evolved for boat keels and steering mechanisms, in terms of both hardware components, functional operation and materials.

For example, U.S. Pat. No. 6,684,804 is entitled Rudder Construction, and discloses a rudder design having a blade attached to the hull with a thinned zone allowing a main rudder part to turn, as well as a flexible zone to create flexibility in a separate section of the rudder.

European Patent Application No. EP 2,213,569 A1 is entitled Dynamic Fin Comprising Coupled Fin Sections, and illustrates a fin having two parallel interfacing fin sections. One fin section is rotationally attached to the other, and the fin sections can provide a substantially cambered shape in certain positions. Coupling elements are also disclosed.

U.S. Pat. No. 3,670,685 is entitled Flexible rudder, and relates to a rudder consisting of a woven plastic water deflecting plate having a trapezoidal shape and supported with tension by a vertically slotted rod in the center plane of the vessels stern. A rudder stock and second slotted rod supporting the back of the woven plate are included.

U.S. Pat. No. 594,068 is entitled Rudder, which describes a rudder made of flexible material secured to the boat at its forward end, and an arm pivoted to the rear end of the rudder and extending forward. The arm is also secured to a pivoted cross-bar, and the rudder can be operated by hand.

However, none of the above-referenced patents or the prior art address the designs, components and/or operation of the instant flexible steering fin and passive cambering, tilting keel, which constitutes a substantial improvement over the art. Furthering previous concepts, the inventions described below provide simple, superior, and effective devices with enhanced performance, thereby creating a useful and beneficial advance in sailboat evolution.

In terms of wingsails, the art is generally devoid of a mastless wingsail having the structure and function of the instant inventions.

It is therefore an objective of the present invention to provide an improved flexible steering fin and passive cambering, tilting keel with custom designed components providing for superior hydrodynamic performance.

It is yet another objective of the present invention to provide an improved flexible steering fin and passive cambering, tilting keel which eliminates problems with prior designs and provides enhanced benefits for operation and control.

It is yet another objective of the present invention to provide an improved mastless wingsail which does not require a supporting mast or related conventional structure.

Finally, it is an objective of the present invention to provide to provide an improved flexible steering fin and passive cambering, tilting keel, as well as a mastless wingsail, both of which are cost effective and operationally efficient while incorporating the above mentioned objects and features.

SUMMARY OF THE INVENTION

Furthering previous sailboat concepts for keels and control fins, the instant inventions comprise a flexible steering fin and passive cambering keel having fundamental simplicity yet enhanced performance and superior operation in terms of design and components. The steering fin is a relatively short and elongated flexible blade with its leading edge fixed beneath the hull. A rod passing through the hull functions as a simple lever controlling the trailing edge of the blade, which provides both tilt and curvature for unique handling and ease of use. A separate flexible keel provides the function of tilting the keel as it is cambered, for greater lift.

A unique fundamental mastless wingsail is also disclosed having minimal components and simplicity of operation.

BRIEF DESCRIPTION OF THE DRAWINGS

The invention may be better understood by reference to the drawings in which:

FIG. 7A is a side plan view of the mastless wingsail of the instant inventions.

FIG. 7B is an end plan view of the apparatus shown in FIG. 7A.

FIG. 7C is a top plan view of the apparatus shown in FIG. 7A.

FIG. 8A is a top plan view of the inventive mastless wingsail and a complementary mini sail.

FIG. 8B is a side plan view of the apparatus shown in FIG. 8A.

DETAILED DESCRIPTION OF PREFERRED EMBODIMENTS

Curve and Tilt Flexible Steering Fin

The modern rudder designs considered to be highly efficient have long blades that extend deep in the water. That depth requirement often creates limitations of where a boat can sail due to shallow water, shoals sand bars, reefs and the like. Therefore, a short and efficient replacement for long blade rudders would be most valuable to sailors. Although the prior art includes numerous steering devices for shallow water, none are as simple and effective as the novel device disclosed and illustrated herein.

Figure 1A:
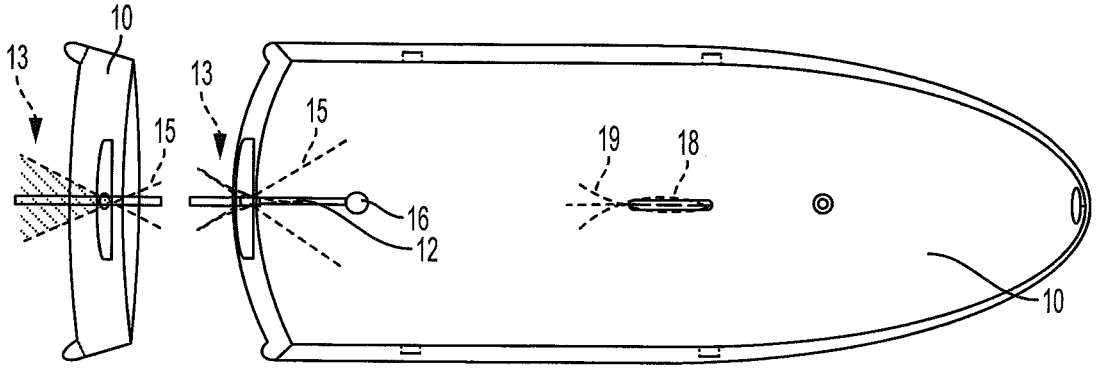
FIG. 1A is a bottom plan view of an inventive sailboat incorporating the instant flexible steering fin and passive cambering keel.
Figure 1C:
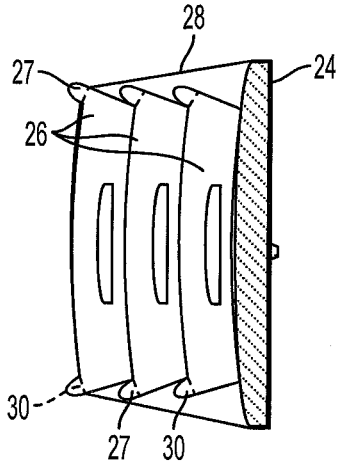
FIG. 1C is a partial front plan view of the nesting hulls of the instant inventions.
Figure 1B:
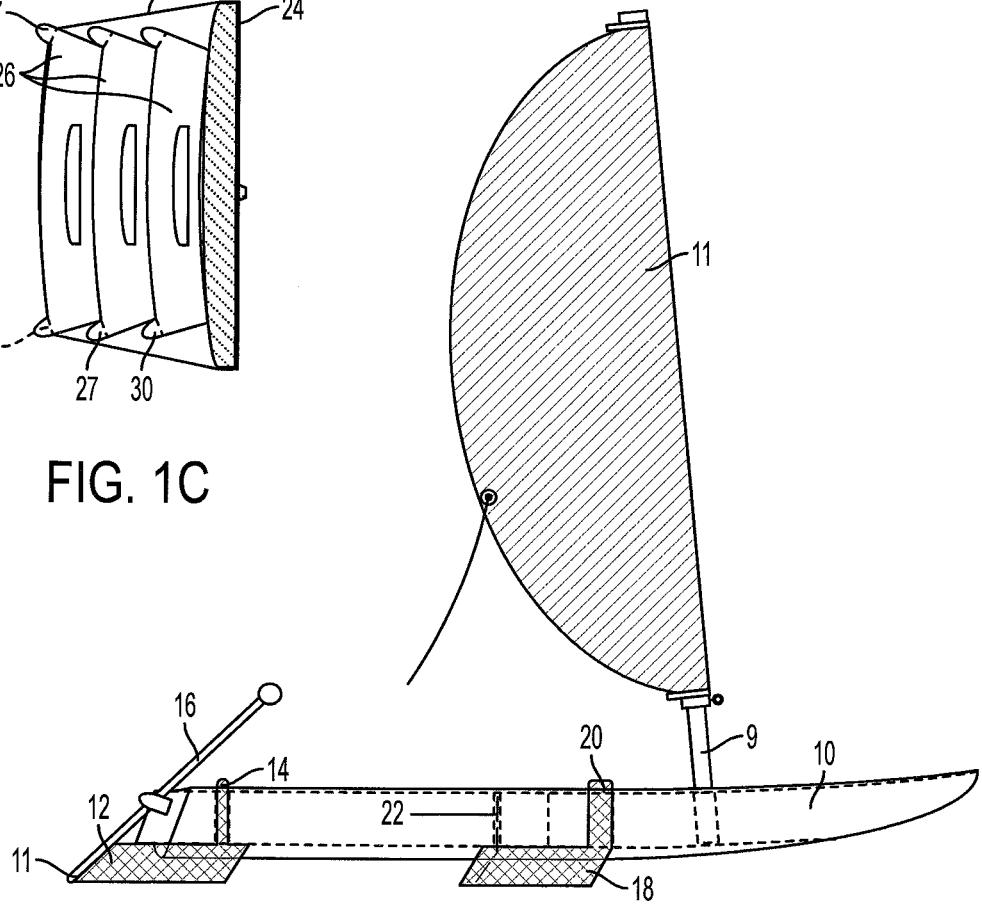
FIG. 1B is a side plan view of an inventive sailboat incorporating the instant flexible steering fin and passive cambering keel.

With reference to FIGS. 1A and 1B, the steering fin 12 and passive keel 18 are shown as mounted within a sailboat hull 10, the boat having a sail 11 and mast 9. As will be further detailed hereinafter, the passive cambering keel includes a mounting member 20 and internal pivoting rod 22 which tilts the blade 18 as it bends as represented in motion lines 19. As water pressure bends the middle inward, curving and tilting of the blade 18 creates maximum lift. Steering fin 12 is mounted beneath hull 10 with vertical mounting member 14 passing through the hull.

The steering fin 12 consists of a flexible blade with its leading end fixed beneath the hull 10. The entire blade, including connection points can be a single molded plastic part. In a preferred embodiment, the blade is made of low density polyethylene, but other plastics, composites and even resilient metals can be used. Rod 16 passing through a hole in the hull functions as simple lever controlling the trailing edge of the fin 12, producing both tilt and curvature as it is moved and pulled from the center to either side. Appropriate materials for the rod 16 include fiberglass, carbon fiber and bamboo. This unique combination of tilt and curvature does not exist in the prior art for boat steering devices. The fin when curved provides a high lift coefficient and the tilt improves the uniformity of pressure distribution across the surface of the blade. Furthermore, the diagonal trailing edge 11 also improves efficiency by reducing vortex drag.

The simple lever version 16 as depicted is most useful on low flat hulls, while a rotating shaft version, and vertical pivoting version are better suited to taller hulls.

The prior art of shallow water keels includes several designs that vary camber in response to side pressure from the flow of water. By adjusting camber automatically, those devices provide useful increases in lift. The instant invention improves over the art with the additional function of tilting the keel as it is cambered. Tilting this curved flexible keel improves flow pressure uniformity, thereby providing even greater lift for improved sailing efficiency. Without the tilt, the flow pressure would decrease with distance from the hull bottom. An additional advantage of this design is that it fits into a standard dagger board opening in the hull, so that either type of device may be used.

As control lever 16 pivots, as illustrated in motion lines 15, it imparts both tilt and curvature to flexible steering fin/plate 12, as illustrated in motion lines 13.

With reference to FIG. 1C, an embodiment of the hull stacking and car roof carrying features are shown. Hulls 26 are illustrated in a nested configuration secured to the roof 24 of a vehicle. The hull is typically made of polyethylene molded over EPS foam, providing high durability, light weight and low cost. The top surface of the hull is both concave and padded. The lateral curvature of that concave surface has a depth of about one inch (25 mm) over the width of forty inches (1 m). That curvature was selected to provide a wide stable contact area when mated to the top of most cars. The longitudinal concavity of the top surface also increases car top mounting stability. Slots 30 in the wing like undersides 27 of the hull provide a stable path for straps 28 that can secure the boat directly to the car roof or a rack. The hull wings also increase buoyancy along the sides of the hull to improve lateral stability in the water. The concave top, convex bottom and wing portions of the hull are also designed to mate securely, so multiple boats can be stacked together securely for storage and transport.

Figure 2A:
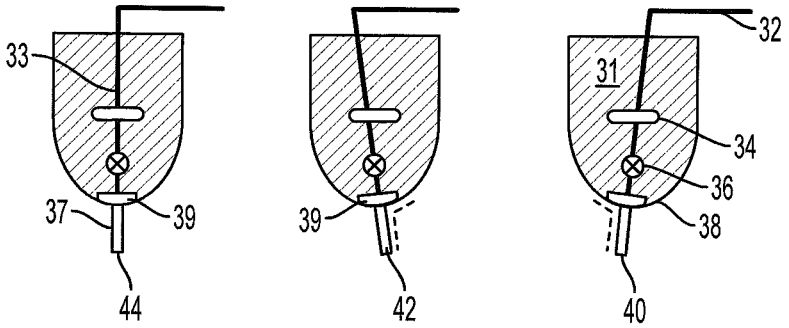
FIG. 2A is a rear transom view of the steering keel and lever actuator.

With reference to FIG. 2A, a transom view of the steering keel and lever actuator are illustrated. The lever action of control arm 33 maximizes turning force by angling the flexible steering keel 37 to pressurize the flow between keel and hull 31. Increased pressure allows the surface area to be smaller than a rudder blade, so the frictional drag will be lower for the equivalent turning force. Top plate 39 reduces vortex drag and pitching motion, while its angle can be made adjustable to control hull trim. Cross bar 32 is attached to the second hull, and control arm 33 is positioned within guide slot 34 to pivot point 36. The pivot arc 38 follows the curvature of the hull. The pressurized water flow and resultant forces acting on keel 37 are illustrated with a port turn 40, starboard turn 42, and straight heading 44.

Figure 2B:
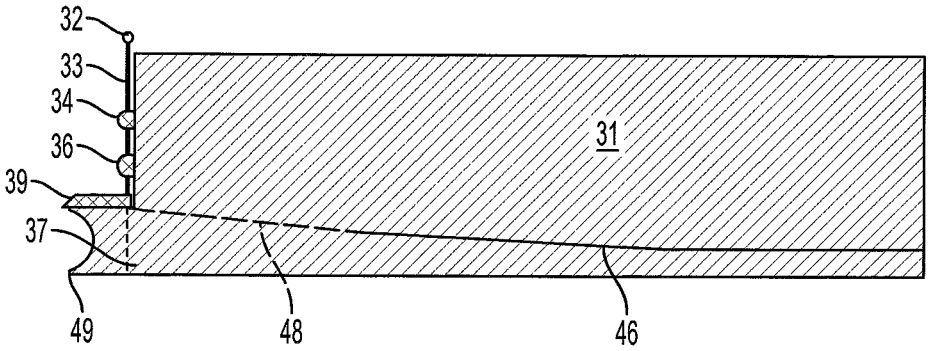
FIG. 2B is a side view of the apparatus shown in FIG. 2A.

FIG. 2B is a side view of the structure and components illustrated in FIG. 2A. As shown, there is a minimal gap 48 between the fixed keel 46 and the steering keel 37, which can also include an anti-vortex curved tip 49.

Unlike rudders, the curved keel 37 is inherently immune to turbulent drag and cavitation at high speed. Fewer parts save cost and weight. Eliminating appendages improves safety, reliability and ease of use. Lower drag increases speed. Kick up rudders will become unnecessary as high speed shallow water sailing will finally be possible.

Figure 3A:
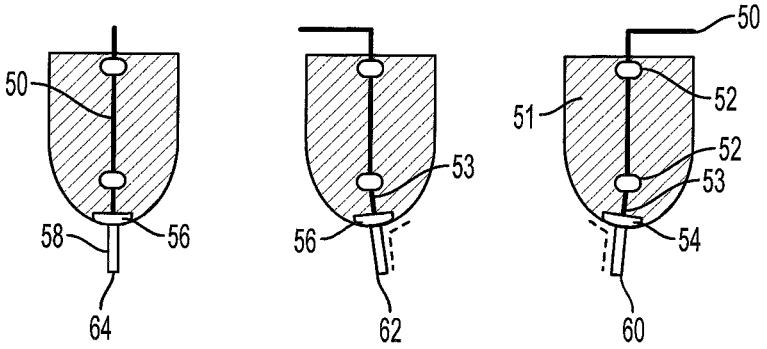
FIG. 3A is a rear transom view of the steering keel and bent rod actuator.

With reference to FIG. 3A, turning tiller/actuator rod 50 maximizes turning force by angling the flexible steering keel 58 to pressurize the flow between keel and hull 51. Increased pressure allows the surface area to be smaller than a rudder blade, so the frictional drag will be lower for the equivalent turning force. Top plate 56 and curved end tip 57 reduce vortex drag and pitching motion, while the angle of the plate can be made adjustable to control hull trim. Unlike rudders, the curved keel 58 is inherently resistant to turbulent drag and cavitation at high speed. Fewer parts save cost and weight. Eliminating appendages improves safety, reliability and ease of use. Lower drag increases speed. As mentioned, deep draft rudders will become unnecessary for high performance and high speed shallow water sailing.

In this embodiment, the actuator rod is positioned within two pivot sockets 52, and the actuator includes bent rod section 53. The pivot arc 54 follows the curvature of hull 51, and the pressurized flow forces acting on the flexible steering keel 58 and resulting curvature is illustrated for port turn 60, starboard turn 62 and a straight heading 64.

Figure 3B:
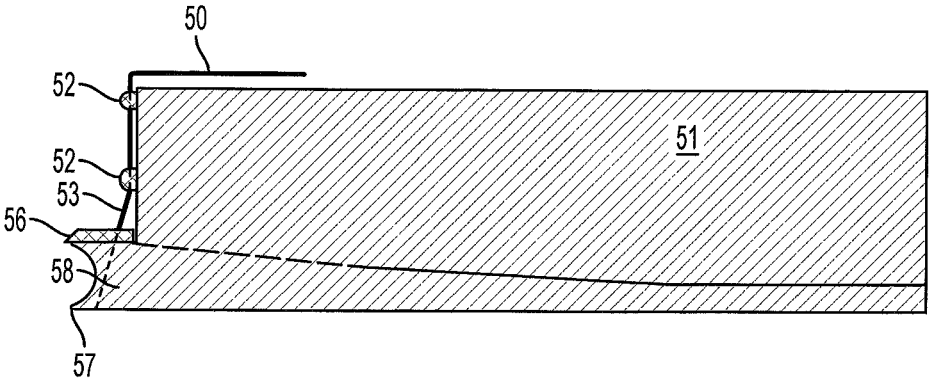
FIG. 3B is a side view of the apparatus shown in FIG. 3A.

FIG. 3B is a side view of the structure and components shown in FIG. 3A.

Appropriate materials for the flexible steering keel include the popular hull materials, polyethylene and fiberglass, so it can be molded as an integral part of the hull. The standard material for the actuator rod is fiberglass and alternate materials include epoxy composites of carbon fiber or stainless steel.

Figure 4A:
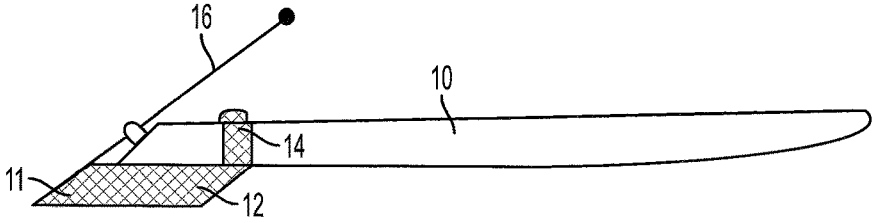
FIG. 4A is a side plan view of the inventive flexible tilt steering fin mounted within a hull.
Figure 4B:
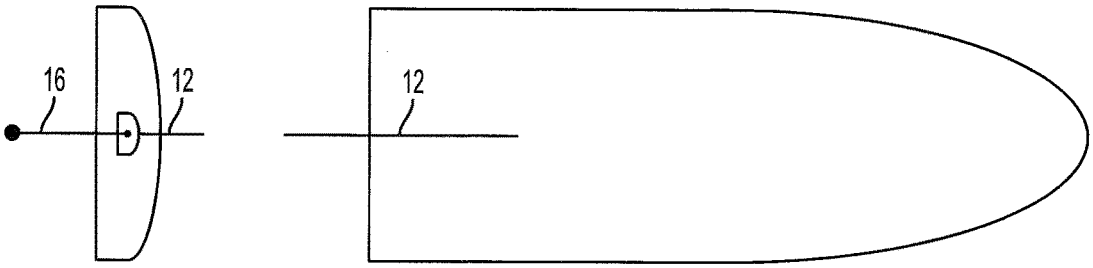
FIG. 4B is a bottom plan view, and end view thereof, of the apparatus shown in FIG. 4A.
Figure 4C:
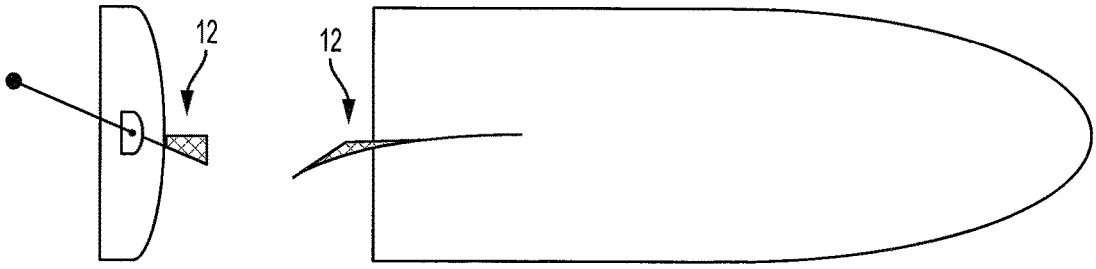
FIG. 4C is a bottom plan view, and end view thereof, of the apparatus shown in FIG. 4B in a starboard biased configuration.
Figure 4D:
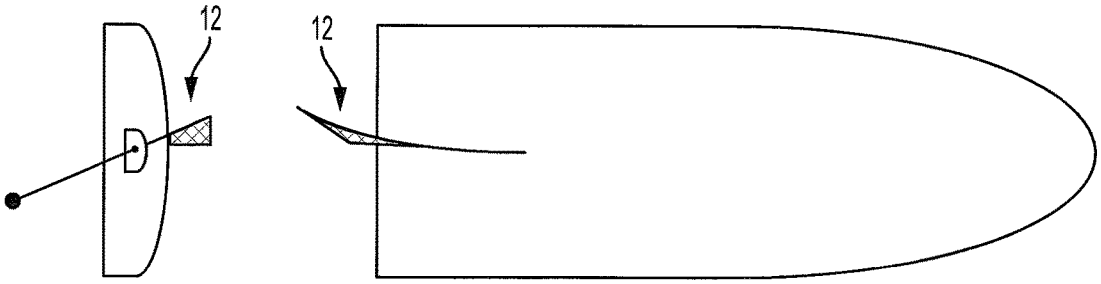
FIG. 4D is a bottom plan view, and end view thereof, of the apparatus shown in FIG. 4B in a port biased configuration.
Figure 4E:
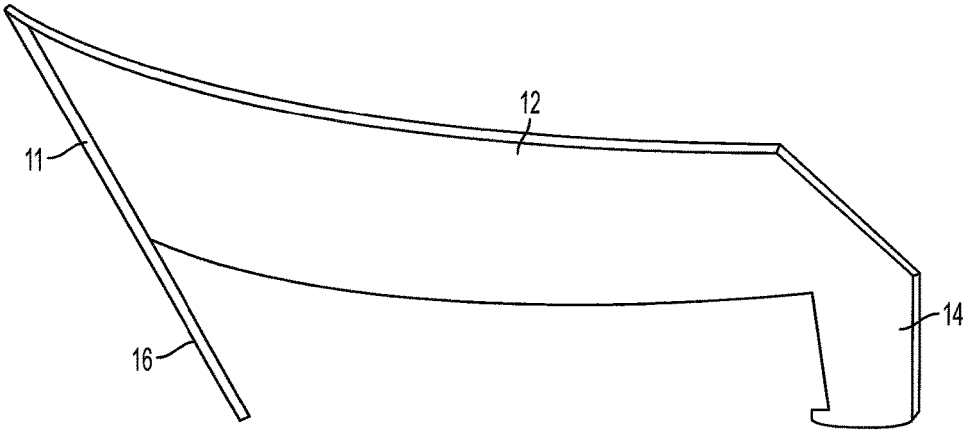
FIG. 4E is a perspective view of the flexible steering blade of the instant invention.
Figure 5A:
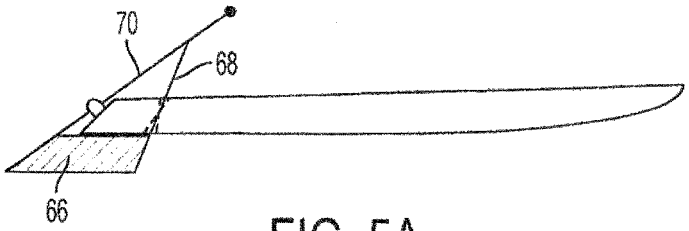
FIG. 5A is a side plan view of and alternative inventive flexible tilt steering fin mounted within a hull.
Figure 5B:
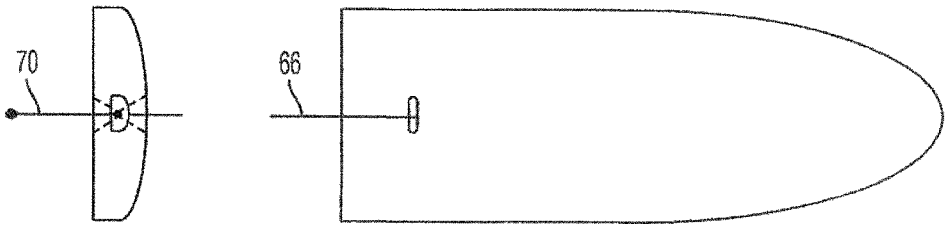
FIG. 5B is a bottom plan view, and end view thereof, of the apparatus shown in FIG. 5A.
Figure 5C:
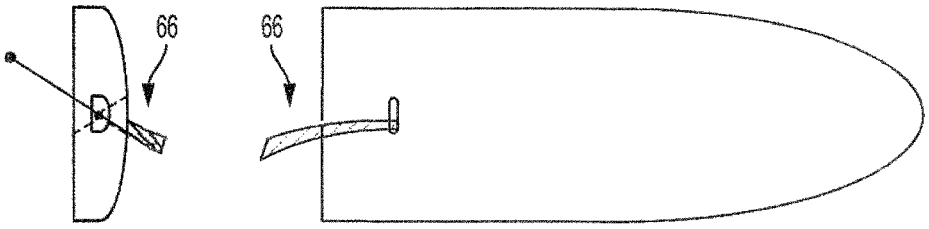
FIG. 5C is a bottom plan view, and end view thereof, of the apparatus shown in FIG. 5B in a starboard biased configuration.
Figure 5D:
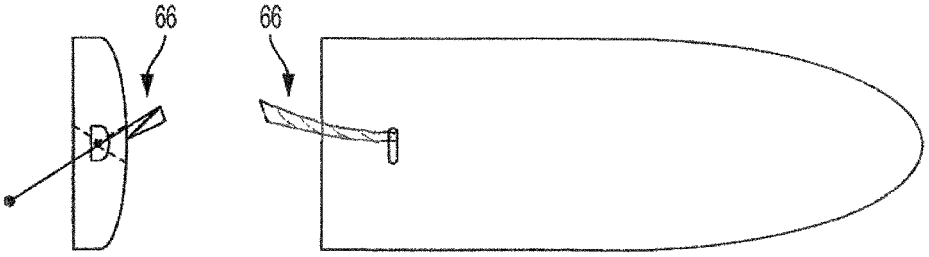
FIG. 5D is a bottom plan view, and end view thereof, of the apparatus shown in FIG. 5B in a port biased configuration.
Figure 5E:
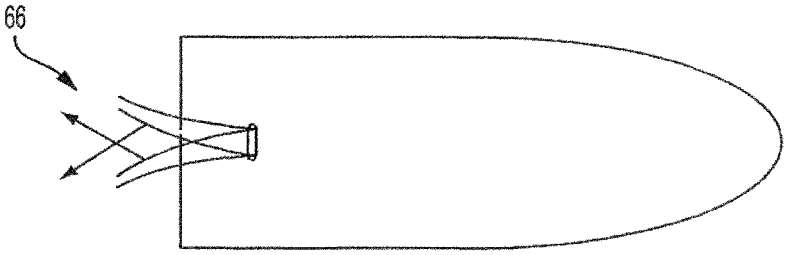
FIG. 5E is a bottom plan view of the apparatus shown in FIG. 5B illustrating the movement of the instant undulating steering blade.

With reference to FIG. 4A, a side plan view of the inventive flexible curve and tilt steering fin 12 is shown mounted within a hull 10 with associated control rod/lever 16, connection at angled end 11, and mounting member 14 having a capped retaining end as an overhang which locks the blade into the hull, all the foregoing described and illustrated with respect to FIGS. 1A and 1B. FIG. 4B depicts the steering fin components in straight heading configuration, and FIGS. 4C and 4D illustrate the undulating curved and tilt fin 12 in starboard and port steering maneuvers by control lever 16 and the resulting action of fin 12 with both tilt and curvature in three dimensions. FIG. 4E is a perspective view of steering fin 12 illustrating the simultaneous three dimensional curved and tilt configurations of the blade.

FIGS. 5A through 5E depict an alternative embodiment of the undulating fin 66, which provides enhanced and efficient thrust in undulation action similar to that of a fish tail. The thrust is produced as it moves from side to side. This embodiment of the steering fin 66 utilizes two resilient rods 68 and 70 to produce an undulating motion that creates forward thrust in addition to providing steering force. The leading edge of this fin is fastened to a resilient rod 68 that extends upward through an opening in the hull. The internal surfaces of the opening form an hourglass shape that provides the leading edge rod with a pivot point inside the hull. A second rod 70 passes through a pivot hole in the transom and is fastened to the trailing edge of the fin. The trailing edge rod is substantially longer than the leading edge rod. The two rods are joined above the hull. Moving the top ends of the rods from the center to either side causes the fin to undulate, because the spring action of the longer rod delays the lateral movement of the trailing edge. Continuous side-to-side movement of the rods produces an undulation pattern with the trailing edge following the lateral movements of the leading edge. This function can be described as biomimetic, because it mimics the thrust producing movement of fish tails. FIGS. 5B through 5E illustrate the undulating motion of the blade 66 when the actuator arm is moved from side-to-side.

Curve and Tilt Passive Cambering Keel

Figure 6A:
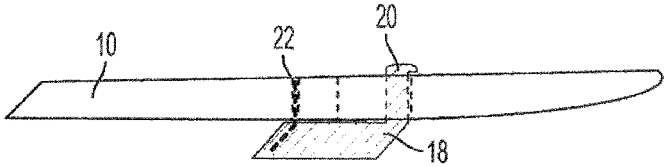
FIG. 6A is a side plan view of the inventive flexible curve and tilt passive cambering keel mounted within a hull.
Figure 6B:
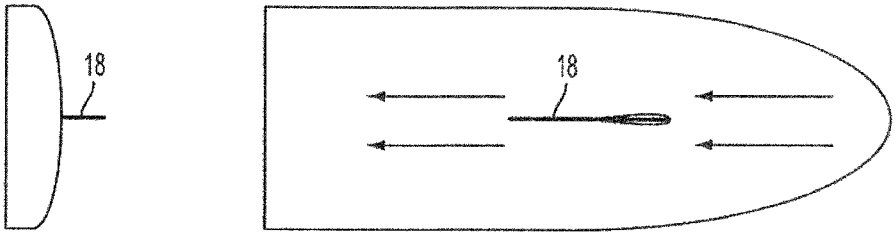
FIG. 6B is a bottom plan view, and end view thereof, of the apparatus shown in FIG. 6A.
Figure 6C:
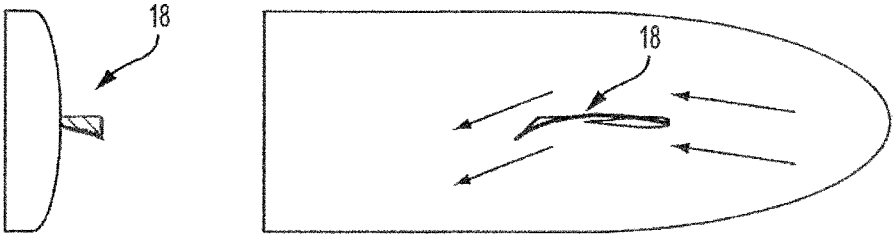
FIG. 6C is a bottom plan view, and end view thereof, of the apparatus shown in FIG. 6B in a starboard biased configuration.
Figure 6D:
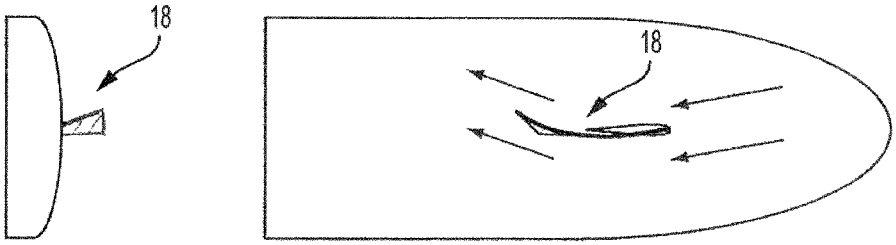
FIG. 6D is a bottom plan view, and end view thereof, of the apparatus shown in FIG. 6B in a port biased configuration.
Figure 6E:
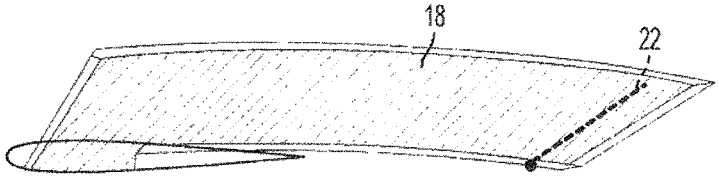
FIG. 6E is a perspective view of the inventive keel in a tilted and curved configuration resulting from encountering hydrodynamic forces.

With reference to FIG. 6A, a side plan view of the inventive flexible curve and tilt passive keel 18 is shown mounted within a hull 10 with associated mounting member 20 having a capped retaining end as an overhang which locks the keel into the hull, all the foregoing described and illustrated with respect to FIGS. 1A and 1B. FIG. 6B depicts the keel components in straight heading configuration, and FIGS. 6C and 6D illustrate the undulating passive curved and tilt keel 18 in starboard and port maneuvers and the resulting action of keel 18 with both tilt and curvature. FIG. 6E is a perspective view of keel 18 illustrating the simultaneous curved and tilt configurations of the keel and pivot rod 22.

Molded into the LDPE blade 18 is a bent stainless steel rod 22 that rotates inside a socket in the hull as the flow pressure curves the blade. The pivoting action tilts the blade to improve flow pressure uniformity thereby improving efficiency.

Mastless Wingsail

The inventive wingsail design presented herein is extremely simple, efficient and robust. Since it does not depend on a mast for support, it is ideally suited as a collapsible sail for small boats or as a tail for controlling the rotational movement of a wingsail. The use of tails to control the rotation of wingsails is documented in prior art.

The inventive mastless wingsail 72 is depicted as a propulsion device in FIGS. 7A through 7C, and as wingsail tail 80 in FIGS. 8A and 8B. This novel structure utilizes a tensioned rod to replace the previous methods of supporting and tensioning sails. The fundamental device consists of a cloth sail 74 and a resilient rod 75. The semi-circular sailcloth surface has an internal sleeve 76 along the curved edge which accommodates rod 75. The preferred rod materials are fiberglass and carbon fiber, but bamboo and hardwoods are viable alternatives. The wingsail surface is tensioned by the insertion of the rod into the sleeve. With the rod inserted and secured in place, a stable and efficient aerodynamic structure is formed. For propulsion, the wingsail may be mounted to a base 77 with a bearing or pivot that allows it to rotate freely. The rod may be secured along a curved path in the base or at several connection points with various combinations of rigid struts and tensioned cords. In the alternative function as a wingsail tail 80 as shown in FIGS. 8A and 8B, the device is supported by a clamping bracket 81 at or near the mid-point of the internal rod.

Figure 9A:
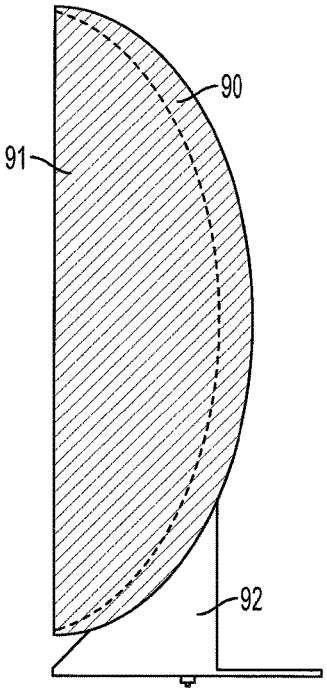
FIG. 9A is a side plan view of the inventive mastless wingsail depicting the moon structure.
Figure 9B:
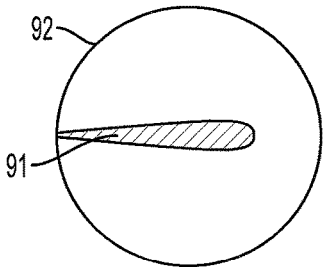
FIG. 9B is a top plan view of that shown in FIG. 9A.
Figure 9C:
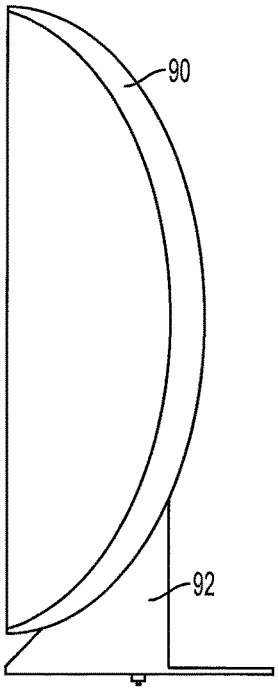
FIG. 9C is an end view of that shown in FIG. 9A.

With reference to FIGS. 9A through 9C, an alternative embodiment of the instant invention replaces the straight rod of the fundamental device with a curved vertical mast 90 that is tensioned inward by the sailcloth surface 91. The preferred cross-sectional profile of the mast is generally elliptical, but can also be round. In this embodiment, base 92 is integrated into the structure of the vertical wing. These parts may be made of aluminum, wood or composites. The base encompasses a robust rotational bearing system anchored to the hull. In this embodiment, the sailcloth surface 91 is raised and lowered by a rope running within the vertical wing structure.

The rotation of the wingsail is controlled by a rope or ropes fastened to the trailing edge. The wingsail rotates freely in response to the wind unless there is tension on the rotation rope. Left free to rotate, it continually turns in the direction of the wind while creating minimal thrust from drag. Thrust is created as aerodynamic lift when the operator uses the rotation rope to pull the wingsail toward the wind. Releasing the rotation rope stops the thrust immediately. This simple on-off function is extremely intuitive and risk free, providing greater safety than previous sailing systems. Moreover, the inherently low drag and high flexibility of the structure eliminates the danger of being overpowered by high winds. Folding the wingsail is also a simple operation, because sliding the rod out of the sleeve makes the wing collapse. The wingsail can also be raised by sliding the rod into the sleeve.

In addition to the novel safety advantages, this inventive wingsail is also substantially more efficient than conventional sails. The semi-circular shape creates the efficiency advantage of elliptical area distribution, which increases the lift to drag ratio by providing uniform pressure distribution without the need for specific contouring of the surface.

Unlike sails, these inventive wingsails can always be aligned to the wind for maximum thrust, even when sailing downwind. With conventional sailing rigs, the mast support wires prevent the sail from rotating toward the front of the boat and therefore limit downwind sailing to the inefficient regime of simply being pushed by the wind. To overcome that limitation, many sailboats raise additional sails when sailing downwind, while this invention provides comparable thrust from a single easily controlled wingsail. Furthermore, the increased lift to drag ratio of this design also minimizes the side pressure that causes sailboats to lean over.

Like other sailing rigs, the alignment of the wingsail to the wind is controlled by a rope or ropes connected to the trailing edge. Unlike most conventional sails, which are located completely behind their connection to the mast, the surface of this wingsail may be balanced by moving a portion of the surface forward of the pivot axis. This balancing effect can be used to cancel most of the turning force produced by wind, creating a 'semi-balanced' condition that greatly reduces the controlling force required to keep the wingsail optimally aligned with the wind. Therefore, the wingsail may be controlled by simply holding the rotation rope directly, providing a more tactile feeling of the wind pressure than when pulleys are used. Nonetheless, rotation control pulleys or other devices may be necessary or preferred depending upon the specific application and individual preferences.

Figure 10A:
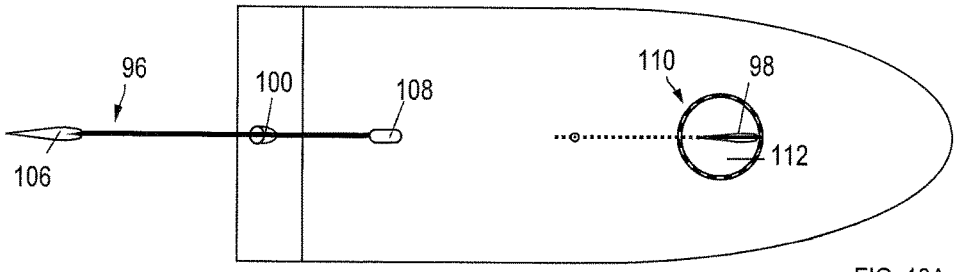
FIG. 10A is a top plan view of an alternative embodiment for the flexible steering fin and passive cambering keel.
Figure 10B:
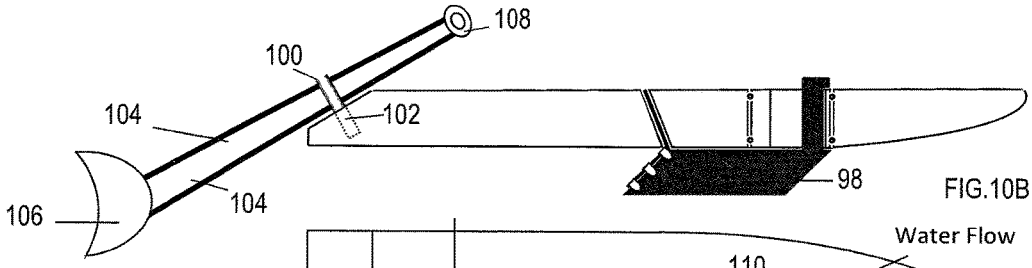
FIG. 10B is a side plan view of the apparatus shown in FIG. 10A.
Figure 10C:
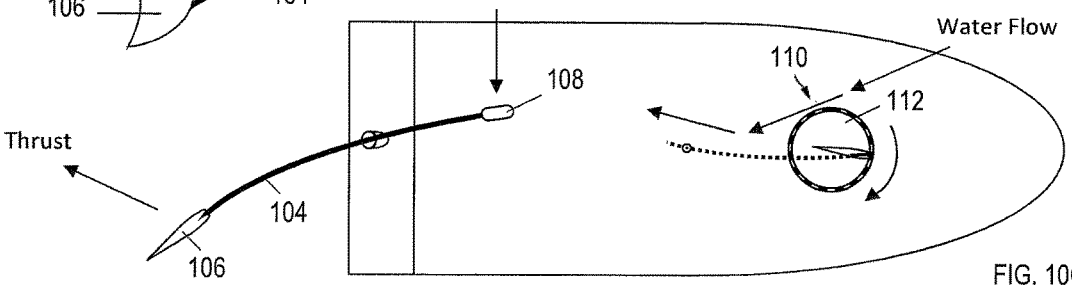
FIG. 10C is an alternative top plan view of the flexible steering fin and passive cambering keel shown in FIG. 10A under forces of water flow and turning actions.

Alternative Embodiments for Curve and Tilt Flexible Steering Fin and Passive Cambering Keel With reference to FIGS. 10A, 10B, and 10C are top plan and side views of an alternative embodiment for the flexible steering fin assembly 96 and passive cambering keel 98. The steering assembly utilizes a rotating pivot mechanism in place of the fixed pivots utilized in embodiments previously illustrated and described. The pivot consists of a section of plastic (or other material) pipe 100 that fits into an angled socket 102 located in the transom of the boat. The portion of the pipe that extends above the hull socket 102 contains two cross holes through which the two tensile rods 104 are inserted. The trailing ends of the rods extend substantially beyond the transom of the boat, supporting a flexible plastic blade 106. The flexibility and multi-axis rotation inherent to this system make it extremely resistant to damage. Moreover, the spring action of the rods 104 functions as a transmission, smoothing the application of force and limiting the peak strain felt by the operator.

A handle 108 is fixed to the leading ends of the rods. Moving handle 108 from the center to either side steers the boat in the same manner as a conventional rudder. However, the longer length of this structure adds leverage that improves efficiency because it provides more turning force for a given blade size. Moving handle 108 from side to side produces thrust from the undulating motion of the flexible rods 104 and blade 106.

Also illustrated are enhancements to the function of the passive keel 98. A circular section 110 of the hull containing the daggerboard slot is provided with bearings 112 that permit the section to rotate freely within the greater hull. As the boat moves forward, any sideways drift will push against one side of the blade, causing the circular hull section 110 to rotate toward the opposite side of the boat. That rotation increases the blade angle automatically, adding efficiency to the inventive curve and tilt blade structure. In conventional sailing terminology, the automatic turning of this keel is described as self-tacking.

FIG. 10C illustrates the flexible steering fin and passive cambering keel under hydrodynamic forces of water flow, as well as rotating and turning actions of rotational bearing assembly 110, 112.

Figure 10D:
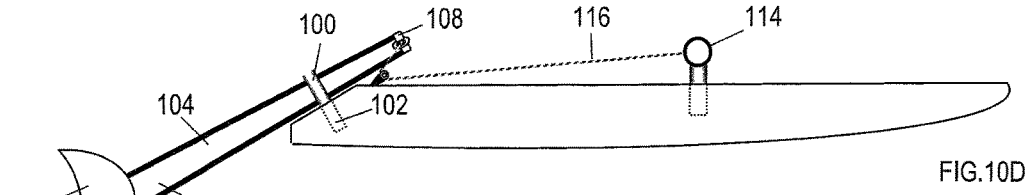
FIG. 10D is a side plan view of alternative embodiment for controlling the steering assembly of FIG. 10A through a pivoting bar mechanism.
Figure 10E:
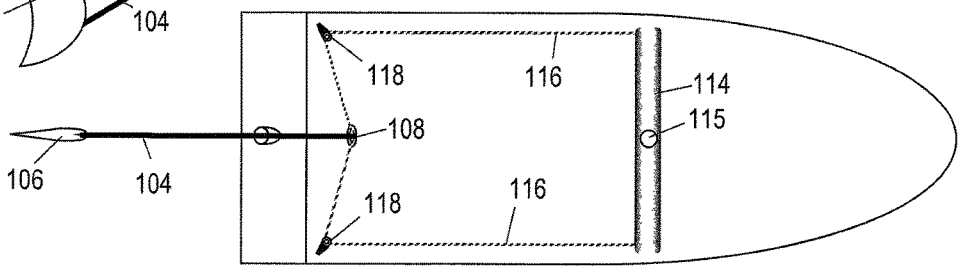
FIG. 10E is a top plan view of the apparatus shown in FIG. 10D.
Figure 10F:
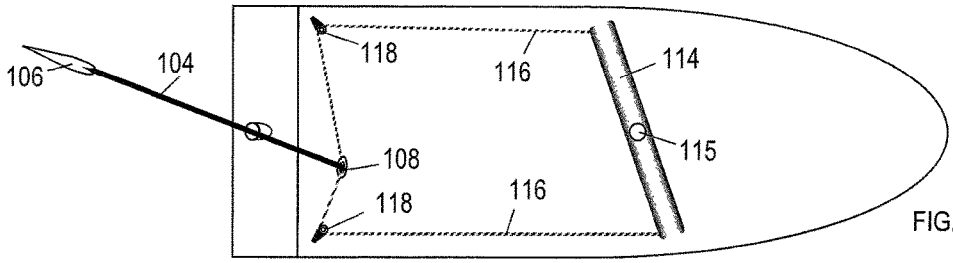
FIG. 10F is an alternative plan view of the apparatus shown in FIG. 10F while manipulating the pivoting bar mechanism.

FIGS. 10D, 10E and 10F depict an alternative embodiment for controlling the steering assembly of FIG. 10A through a pivoting bar mechanism 114, which is pivotally attached to the vessel about center point 115. Steering fin 106 is controlled by pivoting bar 114, which can be controlled by foot movement of the vessel operator. Movement of bar 114 is communicated to rods 104 by a control line (or rope, etc.) that connects the ends of bar 114 to rods 104 as the line passes through a pulley 118 located on each side of the transom. The use of a foot bar provides additional thrust and range, while freeing the operator's hands for other tasks. FIG. 10F illustrates manipulating the pivoting bar 114 mechanism for steering rods 104 and blade 106.

Figure 11A:
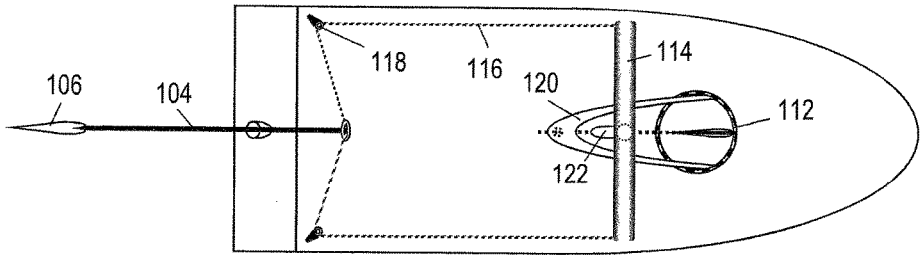
FIG. 11A is a top plan view of an alternative embodiment for the flexible steering fin and passive cambering keel incorporating a rotational circular hull section, frame and cam mechanism.
Figure 11B:
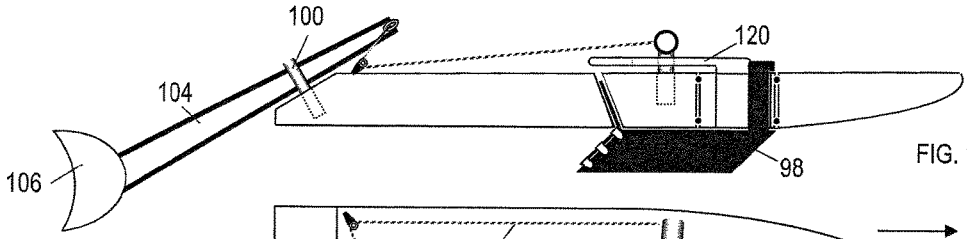
FIG. 11B is a side plan view of the apparatus shown in FIG. 11A.
Figure 11C:
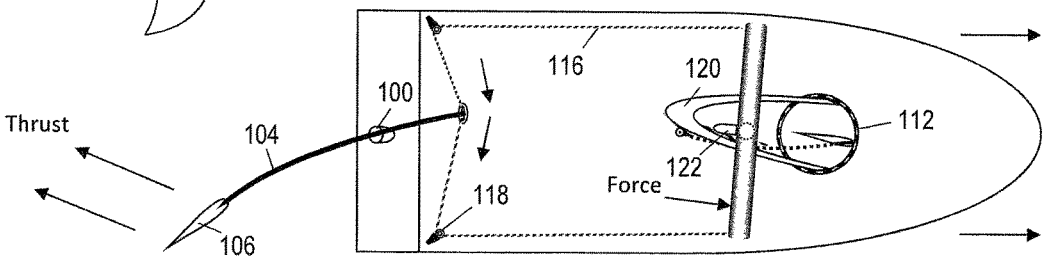
FIG. 11C is an alternative view of the apparatus shown in FIG. 11A while manipulating the steering assembly.
Figure 11D:
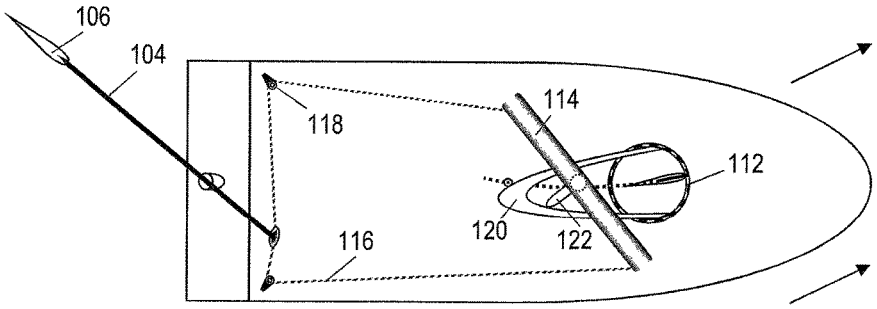
FIG. 11D is another alternative view of the apparatus shown in FIG. 11A while manipulating the steering assembly.

FIGS. 11A through 11D depict an alternative embodiment for the flexible steering fin and passive cambering keel incorporating a rotational circular hull section 110, 112, along with a frame 120 and cam 122 mechanisms. This assembly provides additional controls on the keel. The rotation of the circular hull section 110 is regulated by the interaction of the generally U shaped frame 120 and cam 122, as the rotation of the circular hull section and keel is limited when the inner edges of the frame 120 make contact with the foot bar pivot and cam. This function may be utilized to set the optimal blade angle for maintaining straight line tracking under varying conditions. In addition to resisting the side force produced by sailing, this rotating keel also resists the side to side motion of the hull caused by the oscillation of the steering fin as it drives the boat forward. FIGS. 11C and 11D illustrate the steering and turning action of assemblies.

The stabilizing action of this rotating keel mimics the way fish use their body movements to resist the turning force of their tails when swimming in a straight line. To change from straight line swimming to turning, fish change their body position to augment the turning force of their tails. The instant invention utilizes a cam lobe 122 located on the central pivot 115 to switch between the two functions of resisting turns and augmenting turns. When used for propulsion, the foot bar 114 normally turns between 5 and 20 degrees and cam lobe 122 does not make contact with the frame. To turn the boat, the operator simply pushes the bar beyond 20 degrees, where cam 122 engages the frame to steer the keel. That function completes the natural swimming action of the system.

The above inventions have been described and illustrated with the reference structure, components and functions. Modifications and variations thereof will occur to those of ordinary skill in the art, and it is intended such modifications and variations will be within the scope of the inventive subject matter.

What is claimed is:

1. A sailing vessel, said sailing vessel including a mast and a sail, comprising:
- a hull having a flexible steering blade;
- at least one tensile rod member securing said steering blade to said hull;
- said tensile rod member being resilient; and
- said tensile rod member being pivotally and rotationally secured to said hull.

2. The apparatus of claim 1, further comprising:
- a plurality of tensile rod members;
- a handle attached to one end of said tensile rod members;
- said steering blade attached to the opposite end of said tensile rod members;
- said hull having an angled rear section;
- said tensile rod members pivotally and rotationally secured to said angled rear section.

3. The apparatus of claim 2, further comprising:
- an auxiliary steering means;
- said auxiliary steering means attached to said tensile rod members; and
- said auxiliary steering means controlling movement of said tensile rod members.

4. The apparatus of claim 3, further comprising:
- said auxiliary steering means including a bar member;
- said bar member pivotally secured to said hull;
- a plurality of pulleys secured to said hull;
- a line attached to said bar member;
- said line passing through said pulleys and said handle; and
- wherein movement of said bar member controls movement and steering of said tensile rod members and said blade.

5. A sailing vessel, said sailing vessel including a mast and a sail, comprising:
- a hull having keel;
- a mounting member securing said keel to said hull;
- said keel being flexible and horizontally elongated;
- said keel being a passive cambering blade whereby water pressure causes said blade to both tilt and curve maximizing lift;
- said hull including a circular section of said hull about said mounting member; and
- said circular section including rotational means for allowing said circular section to rotate imparting movement to said keel.

6. The apparatus of claim 5, further comprising:
- said rotational means includes bearings.

7. The apparatus of claim 6, further comprising:
- said keel having a leading edge and a trailing edge;
- a pivoting rod;
- said pivoting rod secured to said hull;
- said pivoting rod secured at its lower end to said keel trailing edge; and
- said pivoting rod tilting said blade as it bends from water pressure.

8. The apparatus of claim 7, further comprising:
- said mounting member being a vertical rod passing through said hull; and
- said vertical rod secured to said leading edge of said keel.

9. The apparatus of claim 8, further comprising:
- a frame member;
- a cam member; and
- said frame member and said cam member limiting movement of said circular section.

* * * * *